United States Patent [19]

Bell

[11] 3,975,813

[45] Aug. 24, 1976

[54] MAGNETIC TILE HOLDER

[76] Inventor: William A. Bell, 286 Rosemont Gardens, Lexington, Ky. 40503

[22] Filed: Nov. 12, 1975

[21] Appl. No.: 631,320

[52] U.S. Cl. ..... 29/270; 294/65.5

[51] Int. Cl.[2] ..... B25B 27/00

[58] Field of Search ..... 29/270; 294/65, 65.5, 294/64 R

[56] References Cited

UNITED STATES PATENTS

| | | | |
|---|---|---|---|
| 512,381 | 1/1894 | Keyes | 294/65.5 |
| 3,643,992 | 2/1972 | Jacobucci | 294/65 |
| 3,866,300 | 2/1975 | Bell | 29/270 |

*Primary Examiner*—James L. Jones, Jr.
*Attorney, Agent, or Firm*—Bacon & Thomas

[57] ABSTRACT

A holder for setting a group of tiles on a receiving surface has a base plate provided with permanent magnets dispersed over its surface to hold an array of magnetically attractable tiles. Pusher pins slide through the plate to push tiles therefrom. In an alternate form the plate is made of or incorporates magnetically attractable material for holding tiles having permanent magnets therein.

3 Claims, 3 Drawing Figures

MAGNETIC TILE HOLDER

BACKGROUND OF THE INVENTION

This invention is in the field of tile setting devices.

There are known devices for holding a group of abutting or adjacent tiles in a desired array for applying the group, as a unit, to a wall or other supporting surface. Such devices usually apply clamping pressure to the edges of the group to hold them in the desired arrangement. Some such devices have spacer means to engage the edges of the tiles to hold them in a particular array but such devices are limited to the handling of tiles of specific or predetermined shape and are not adapted to handle tiles having different shapes or sizes.

SUMMARY OF THE INVENTION

The present invention comprises a base plate having magnetic means thereon to attract and hold magnetically attractable tiles, which may be placed thereon in any desired array. The device further includes means for pushing the tiles off the holder when desired.

It is, therefore, a principal object of this invention to provide a device for receiving and holding tiles of diverse shapes and sizes in any desired array and permitting the placement of the entire group, as a unit, onto a receiving surface.

It is a further object of this invention to provide such a device capable of holding and arranging tiles of many different materials.

DESCRIPTION OF A PREFERRED EMBODIMENT

Figure 1:
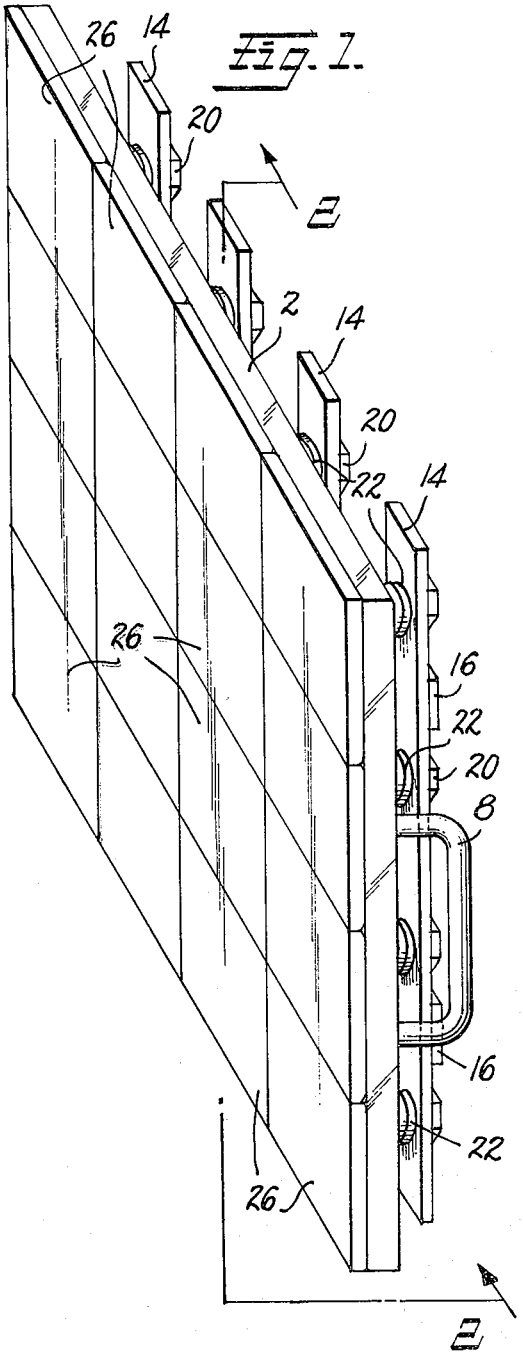
FIG. 1 is a perspective view of a representative form of tile holding device embodying the present invention.

As shown in the drawings, the device of the present invention comprises a base plate 2 which may be of any suitable material, either rigid or somewhat flexible. If somewhat flexible, the device can readily accommodate to any curvatures or uneveness of a wall on which the tiles are to be placed. The base plate 2 has embedded therein a multiplicity of permanent magnets 4 dispersed over the entire front face thereof and preferably arranged with their outer surfaces substantially flush with the outer surface 6 of the base plate 2. However, the magnets could be embedded completely within the material of the base plate.

The base plate is provided with suitable opposed handles 8 fixed thereto whereby the user may manually manipulate the holder and tiles thereon.

The base plate 2 is further provided with a multiplicity of openings 10 extending therethrough in which pusher pins 12 are arranged to slide or project. The pins 12 extend through a lattice or framework comprising horizontal bars 14 and vertical bars 16 secured together, such as by welding, to define a rigid structure. Cross pins 18 in the pins 12 engage one side of the bars 14 and suitable nuts 20 threaded to the outer ends of the pins 12 fixedly clamp those pins to the rigid frame defined by the latticework described. Surrounding each pin 12 is a compression spring 22 bearing at one end against the bars 14 and at their other ends against washers or the like 24 bearing against the base plate 2. Thus, the springs 22 constantly urge the latticework and the pins 12 in a rearward direction so that the forward ends of the pins 12 do not project forwardly of the front surface 6 of the base plate.

Figure 2:
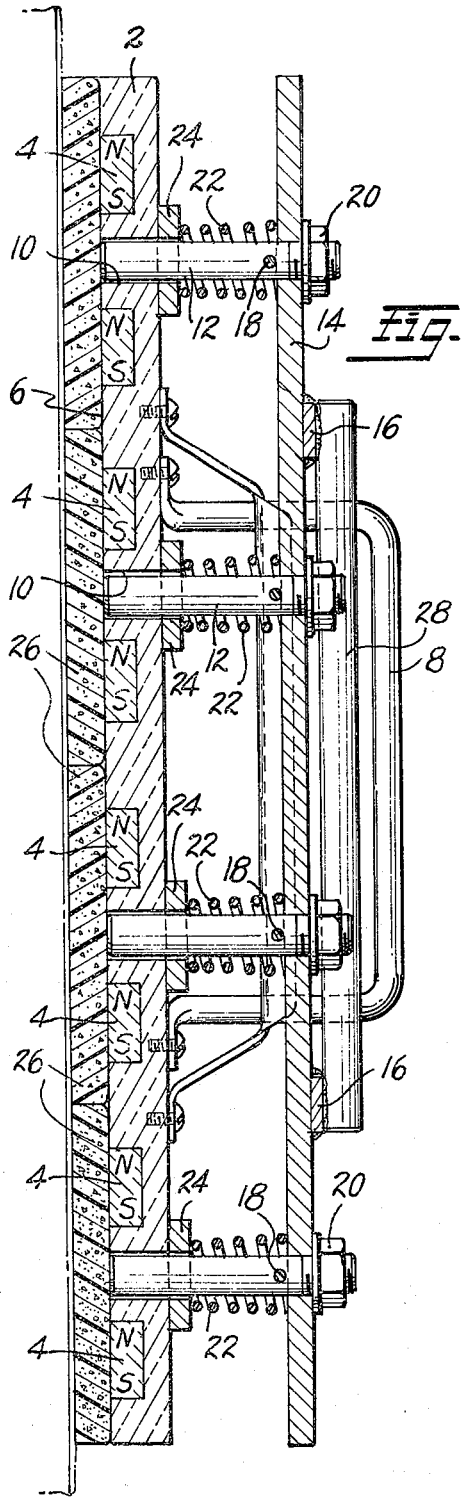
FIG. 2 is a sectional view, on an enlarged scale, taken along the line 2—2 of FIG. 1.

FIGS. 1 and 2 show tiles 26 arranged in abutting relationship on the front face of the base plate 2. As illustrated, the tiles 26 are represented as ceramic tiles, the material of which includes iron powder or the like, but may be any material or particles that are magnetically attractable. Thus, when the tiles are placed as shown on the plate 2, attraction of the magnets 4 holds those tiles in the arranged array and the entire group of tiles may be manipulated as a unit to be placed against a wall on which suitable adhesive material has been applied. When the tiles are in position against the wall, sufficient pressure may be applied through the handles 8 to properly seat all tiles of the group against the wall. Thereafter, the thumbs of the hands grasping the handles 8 may be pressed against bars 28, welded or otherwise secured to the bars 16 adajcent the handles 8, to hold the latticework 14–16 and pins 12 in a forward position while the handles 8 are pulled rearwardly. This results in pulling the base plate 2 rearwardly away from the tiles while holding the tiles against the wall by virtue of pressure applied through pins 12. Thus, the magnets 4 are pulled away from the tile sufficiently to break the magnetic attraction therebetween and leave those tiles adhered to the supporting surface.

Figure 3:
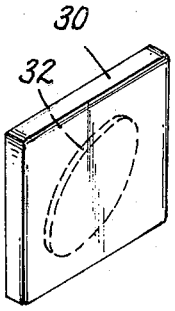
FIG. 3 is a perspective view of a different type of tile adapted to be handled by the present device.

FIG. 3 schematically illustrates a different type of tile 30 having embedded therein a magnetically attractable member 32. Such form of tile may be resorted to when the material thereof is unsuitable for being compounded or made in such a way as to be in itself magnetically attractable. Also, it is contemplated that permanent magnet means may be incorporated in the tiles themselves rather than in the base plate 2, in which case the base plate would be of magnetically attractable material or have such material incorporated therein.

The foregoing description and drawings illustrate a base plate 2 having no means for laterally positioning or confining tiles placed thereon. This provides for great flexibility in arranging the tiles and in the shape of tiles capable of being handled. However, it is within the contemplation of this invention that the base plate may be provided with spacing means to engage the edges of the tiles, as shown in my previous U.S. Pat. No. 3,866,300, issued Feb. 18, 1974. That patent also shows spacer means at the edges of the base plate for porperly spacing the group of tiles thereon from tiles previously applied to a supporting surface. If desired, such means may also be provided on the base plate disclosed herein.

The present invention is adaptable to tiles of any material as long as they incorporate magnetic means of the type referred to and the tiles may be applied to the supporting surface by first supplying adhesive material on the surface and pressing the tiles thereagainst or the adhesive material may be placed on the array of tiles themselves before being applied to a wall or the like.

While a specific embodiment of the invention has been shown and described, the same is merely illustrative of the principles involved and other embodiments may be resorted to within the scope of the appended claims.

I claim:

1. A holder for releasably holding a plurality of tiles in predetermined array comprising:

a generally planar base member having spaced magnetic means dispersed throughout the area thereof for holding a plurality of magnetically attractable tiles on a forward face thereof; and selectively operable means movable forwardly through said base member to engage tiles thereon and push said tiles from said base member against the action of said magnetic means, said last named means comprising a plurality of pins slidable forwardly through said base member between said magnets, and

2. A holder as defined in claim 1 wherein said magnetic means comprises a plurality of permanent magnets in said base member and substantially flush with the forward surface thereof.

3. A holder as defined in claim 1 including spring means arranged to urge said pins rearwardly of said surface free of contact with any tiles thereon.

* * * * *